US012704333B2

(12) United States Patent
Winter et al.

(10) Patent No.: US 12,704,333 B2
(45) Date of Patent: Aug. 11, 2026

(54) AMPHIPHILIC MINICHANNEL SURFACE STRUCTURES TO ENHANCE HEAT TRANSFER COEFFICIENT

(71) Applicant: Drexel University, Philadelphia, PA (US)

(72) Inventors: Rebecca L. Winter, Lakewood, OH (US); Emre Olceroglu, San Francisco, CA (US); Matthew McCarthy, Media, PA (US)

(73) Assignee: Drexel University, Philadelphia, PA (US)

( * ) Notice: Subject to any disclaimer, the term of this patent is extended or adjusted under 35 U.S.C. 154(b) by 274 days.

(21) Appl. No.: 18/116,335

(22) Filed: Mar. 2, 2023

(65) Prior Publication Data

US 2023/0280115 A1 Sep. 7, 2023

Related U.S. Application Data

(60) Provisional application No. 63/316,434, filed on Mar. 4, 2022.

(51) Int. Cl.
*F28F 13/18* (2006.01)

(52) U.S. Cl.
CPC ..... *F28F 13/187* (2013.01)

(58) Field of Classification Search
CPC .. F28F 13/187; F28F 19/04; F28F 1/24; F28F 13/182; F28F 2245/02; F28F 2245/04
See application file for complete search history.

(56) References Cited

U.S. PATENT DOCUMENTS 3,077,659 A * 2/1963 Holzwarth ..... C23C 4/08 427/427
3,496,752 A * 2/1970 Czikk ..... B21C 37/20 72/377
3,990,862 A * 11/1976 Dahl ..... F28F 13/187 428/587
4,060,125 A * 11/1977 Fujie ..... F28F 13/187 29/890.03
4,359,086 A * 11/1982 Sanborn ..... F28F 13/187 165/907
4,663,243 A * 5/1987 Czikk ..... C23C 4/02 428/553
4,753,849 A * 6/1988 Zohler ..... F28F 13/187 165/907
4,846,267 A * 7/1989 Shattes ..... C22F 1/04 428/687
5,018,573 A * 5/1991 Zohler ..... F28F 13/187 427/373

(Continued)

FOREIGN PATENT DOCUMENTS

CA 1330465 C * 6/1994 ..... F28F 13/187
CN 112313279 A * 2/2021 ..... C08L 27/18

(Continued)

*Primary Examiner* — Ljiljana V. Ciric
(74) *Attorney, Agent, or Firm* — Joseph E. Maenner; Maenner & Associates, LLC

(57) ABSTRACT

A structure for enhancing condensation and wetting dynamics includes a substrate and a channel formed in the substrate, forming fins. The fins have a hydrophilic surface. Each of the fins has a portion furthest from the substrate. A hydrophobic coating is formed over only the portion furthest from the substrate on each of the fins.

12 Claims, 4 Drawing Sheets

(56) References Cited

U.S. PATENT DOCUMENTS 6,254,997 B1 * 7/2001 Rettig ..... C23C 4/073 416/241 B
7,360,581 B2 * 4/2008 Tuma ..... H01L 23/3733 257/E23.095
7,695,808 B2 * 4/2010 Tuma ..... C23C 28/321 428/323
7,789,127 B2 * 9/2010 Lu ..... F28F 13/187 165/184
8,875,780 B2 * 11/2014 Smith ..... F28F 1/325 72/370.14
9,664,459 B2 * 5/2017 Wilding ..... F28F 9/02
11,015,878 B2 * 5/2021 Alahyari ..... F28D 15/046
11,118,067 B2 * 9/2021 Aizenberg ..... C10M 105/56
11,441,852 B2 * 9/2022 Brockway ..... B05D 5/02
2007/0251249 A1 * 11/2007 Burk ..... F28F 13/10 62/304
2008/0196876 A1 * 8/2008 Cao ..... F28F 13/187 165/181
2010/0071880 A1 * 3/2010 Kim ..... F28D 15/0266 165/104.26
2014/0366568 A1 * 12/2014 Kim ..... F28F 17/005 62/272
2015/0233588 A1 * 8/2015 Betts ..... F28D 7/106 62/271
2018/0306533 A1 * 10/2018 Alahyari ..... F28F 19/006
2021/0389058 A1 * 12/2021 Iwasaki ..... B23P 15/26
2023/0280106 A1 * 9/2023 Hannah ..... F28D 7/087 165/183
2023/0280115 A1 * 9/2023 Winter ..... F28F 13/182 165/133

FOREIGN PATENT DOCUMENTS

CN 114829142 A * 7/2022 ..... F28F 13/14
EP 0107858 A1 * 5/1984 ..... C23C 4/129
EP 0107858 B1 * 12/1986 ..... C23C 4/02
EP 2813793 A1 * 12/2014 ..... F24F 1/14
TW 202142406 A * 11/2021 ..... B32B 27/30
WO WO-2010032895 A1 * 3/2010 ..... B22F 3/10
WO WO-2017070093 A1 * 4/2017 ..... F28F 19/02
WO WO-2020090677 A1 * 5/2020 ..... F28F 21/084

* cited by examiner

AMPHIPHILIC MINICHANNEL SURFACE STRUCTURES TO ENHANCE HEAT TRANSFER COEFFICIENT

CROSS-REFERENCE TO RELATED APPLICATION

The present application claims the benefit of U.S. Provisional Patent Application Ser. No. 63/316,434, filed on Mar. 4, 2022, which is incorporated herein by reference in its entirety.

STATEMENT OF GOVERNMENT INTEREST

This invention was made with government support under Contract Nos. 1454407 and 1511453 awarded by the National Science Foundation. The government has certain rights in the invention.

BACKGROUND OF THE INVENTION

Field of the Invention

The invention relates to forming amphiphilic minichannel surfaces and coating the surfaces to improve condensate formation and subsequent heat transfer.

Description of the Related Art

It is presently known to coat industrial equipment with coatings to improve heat transfer away from the equipment. An exemplary method is to coat the equipment in a thin coating of polytetrafluoroethylene (Teflon®). While this coating method adequately conducts heat from the equipment, the coating must be necessarily thin to adequate conduct the heat and not form a thermally insulating barrier, but this thin coating does not last in an industrially active environment, resulting in a loss of thermal conductivity and/or requiring re-applications of the coating on a regular basis.

It would be beneficial to provide a heat conducting surface that is efficient and durable.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a structure for enhancing condensation and wetting dynamics. The structure includes a substrate and a plurality of grooves formed in the substrate, forming fins. The fins having fin tops and a coating is applied over the fin tops.

In another embodiment, the present invention is a structure for enhancing heat transfer away from a substrate. The structure includes a thermally conductive substrate and a plurality of grooves formed in the thermally conductive substrate, forming fins. The fins having fin tops and a coating is applied over the fin tops. The coating has a lower thermal conductivity than the substrate.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 2:
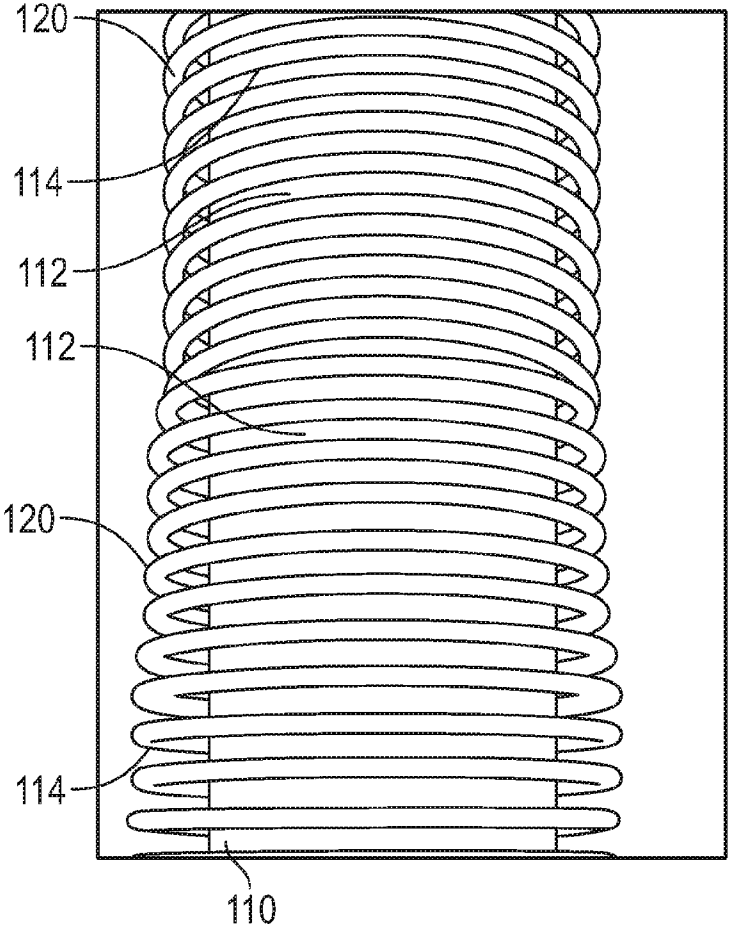
FIG. 2 is an enlarged top plan view of the tube of FIG. 1, with a polymer amphiphilic coating applied to the fins.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Condensation across finned aluminum tubes was studied to demonstrate the use of amphiphilic minichannel (AMC) surface structures to enhance heat transfer coefficient (HTC). The AMCs are extremely robust as well as cheap and easy to fabricate using traditional methods. The 3D structures use mixed-wettability to change surface wetting, leading to dynamic variations in the condensate formation and removal process. Various geometric designs have been fabricated and tested, showing up to 50% enhancement in HTC compared to surfaces without AMCs. Two distinct wetting behaviors have been observed, for vertical and horizontal extending surfaces, both of which can be predicted accurately using developed models.

Figure 1:
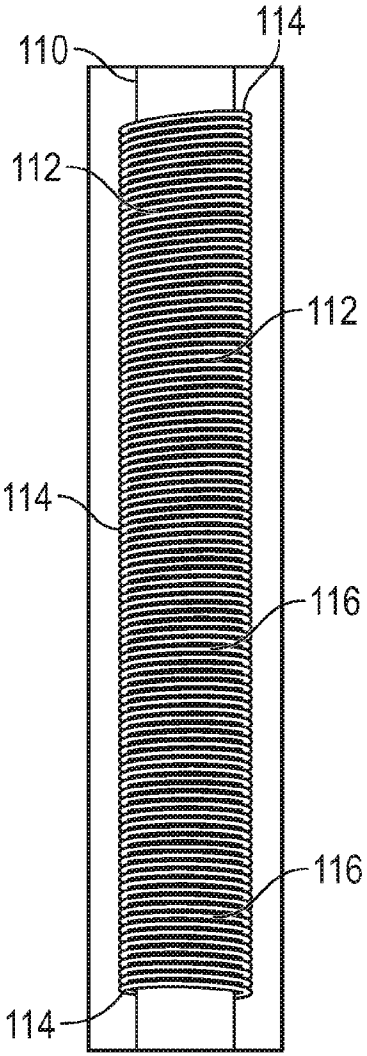
FIG. 1 is a top plan view of a six inch tube machined with fins according to an exemplary embodiment of the present invention.
Figure 3:
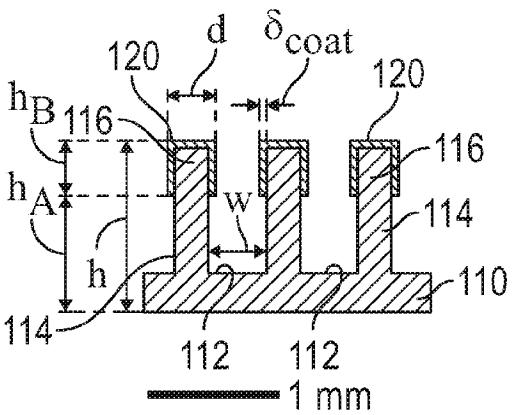
FIG. 3 is a schematic side elevational view showing the geometry of the tube of FIG. 2.
Figure 4A:
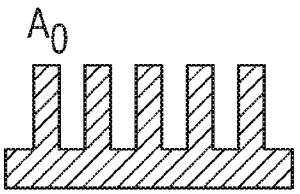
FIG. 4A is a schematic side elevational view showing the geometry of an uncoated tube.
Figure 4B:
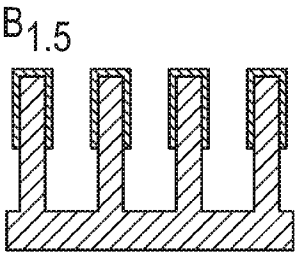
FIG. 4B is a schematic side elevational view showing the geometry of a coated tube.
Figure 4C:
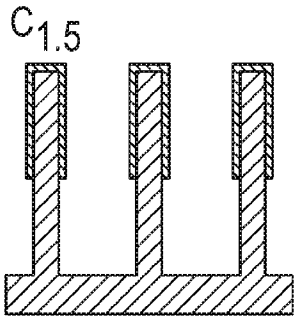
FIG. 4C is a schematic side elevational view showing the geometry of a coated tube with different geometry.

FIG. 1 shows a six-inch-long grooved aluminum tube 110 before coating, where the grooved surface 112 is a single helical channel milled into the tube 110. FIG. 2 shows a close up of a tube 110 after coating with a polymer, such as silicone rubber 120. FIG. 3 shows a cross section of the amphiphilic channel geometry with the following parameters:

- h=the total height of a fin formed by milling adjacent channels on each side of the fin.
- w=the width of the channel.
- d=the thickness of the fin.
- $\delta_{coat}$=the thickness of the coating on the fin.
- $h_B$=the length of the coating extending downwardly from the tip of the fin.
- $h_A$=the uncoated height of the fin ($h-h_B$).

In an exemplary embodiment, h, w, and d can be between about 0.1 mm and about 5 mm; $\delta_{coat}$ can be between about 0.1 microns and about 200 microns; $h_B/h$ can be between about 0.01 and about 0.99.

In general, referring to FIGS. 1-3, the present invention is a tubular substrate 110 with a plurality of helical grooves 112 formed in the substrate 110, forming fins 114 that extend outwardly from the surface of tube 110. The fins 114 have fin tops 116. A coating 120 is applied over the fin tops 116.

In an exemplary embodiment, the substrate 110 comprises a metal, such as, for example, aluminum, and has a first, higher thermal conductivity and has a hydrophilic surface. As shown in FIG. 1, the plurality of grooves 112 has a helical shape, although grooves 112 can be other shapes, such as longitudinally straight or radially straight. The structure of the substrate 110 being tubular is important due to the fact that, for horizontally running tubular substrates (i.e. pipes) 110, condensate that forms on the top of the substrate 110 eventually will roll down either side of the substrate 110 to an underneath portion of the substrate 110, and will eventually fall from the substrate 110, providing room for more condensate to form on substrate 110 and repeat the process, removing heat from the substrate 110 in the process.

The coating 120 comprises a polymer/rubber material having a lower thermal conductivity than the substrate 110 and is a hydrophobic surface. A ratio of a height of each fin below the coating versus a distance between adjacent fins is shown in FIG. 3 as $h_B/w$ and can be between about 0.1 and about 10.

FIGS. 4A-4C and 5A-5D show scale drawings of various geometries of fins and coatings tested, including two uncoated samples (FIG. 4A and FIG. 5A) where channel gaps and heights vary from 0.2-2.0 mm. All samples were tested during condensation of water vapor and at a fixed supersaturation, with small measurable amounts of noncondensable gases. For the configurations of FIGS. 5A-5D, the surfaces were imaged using high speed cameras and condensate removal (and heat transfer rate) were calculated from motion tracking of falling droplets.

Figure 5A:
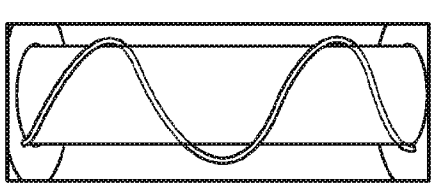
FIG. 5A is a high speed image showing wetting for the profile to the left.
Figure 5B:
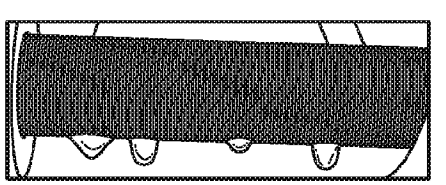
FIG. 5B is another high speed image showing wetting for the profile to the left.
Figure 5C:
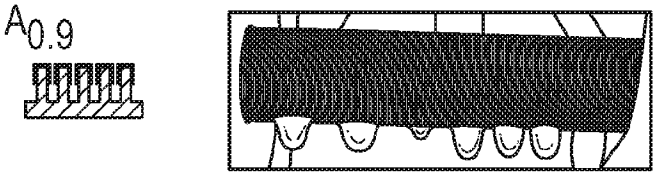
FIG. 5C is yet another high speed image showing wetting for the profile to the left.
Figure 5D:
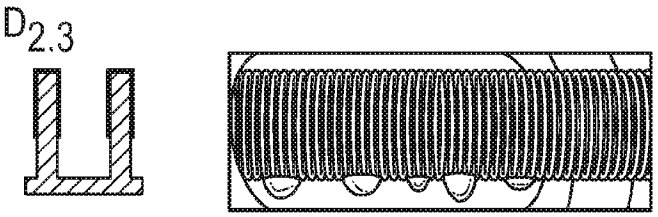
FIG. 5D is still another high speed image showing wetting for the profile to the left.
Figure 6A:
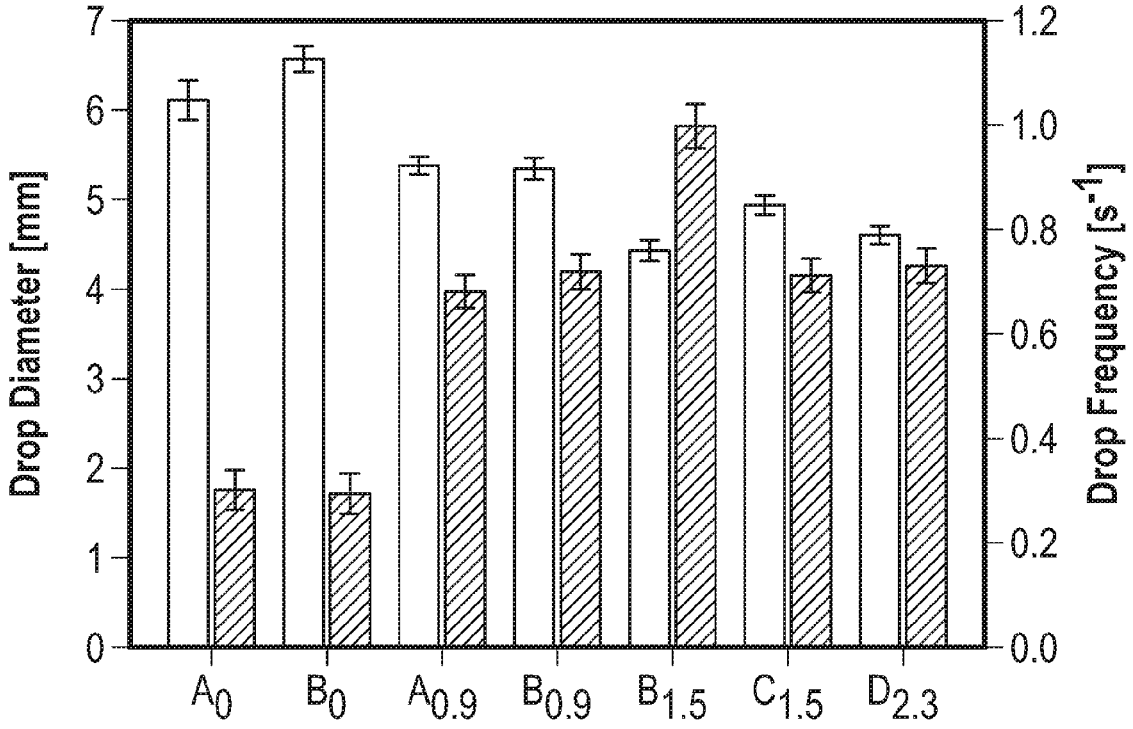
FIG. 6A is a graph showing experimental results for the profiles of FIGS. 4A-4C and 5A-5D of droplet departure diameter in white bars and frequency in gray bars.
Figure 6B:
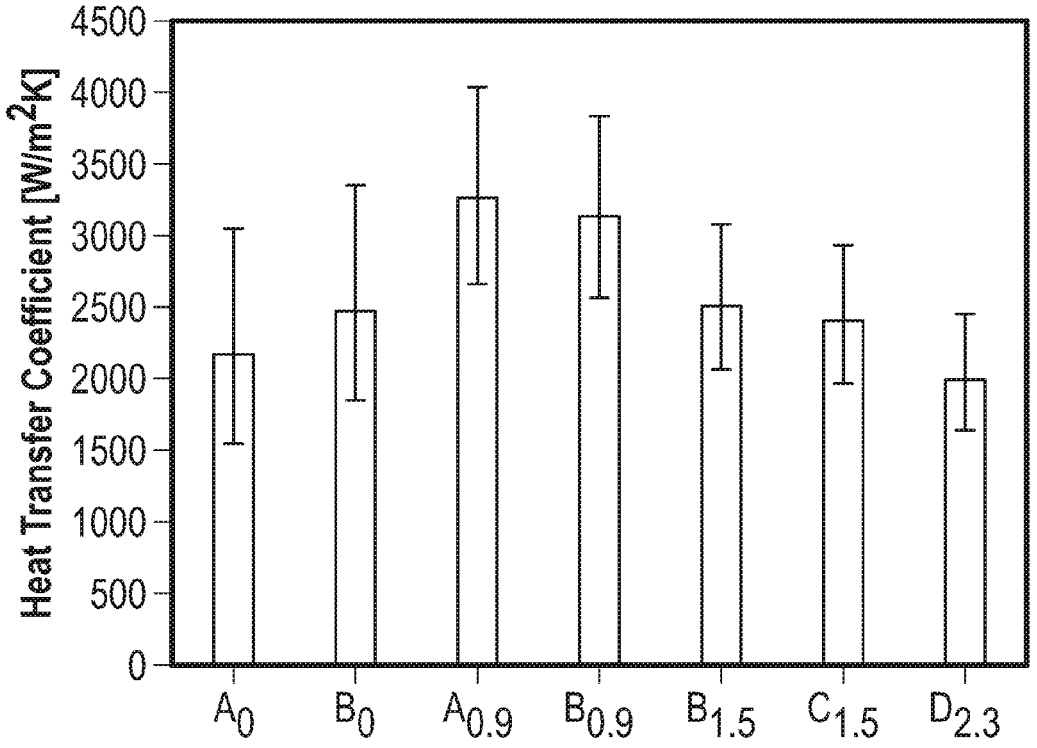
FIG. 6B is a graph showing experimental results for the profiles of FIGS. 4A-4C and 5A-5D of heat transfer coefficient (HTC)
Figure 7A:
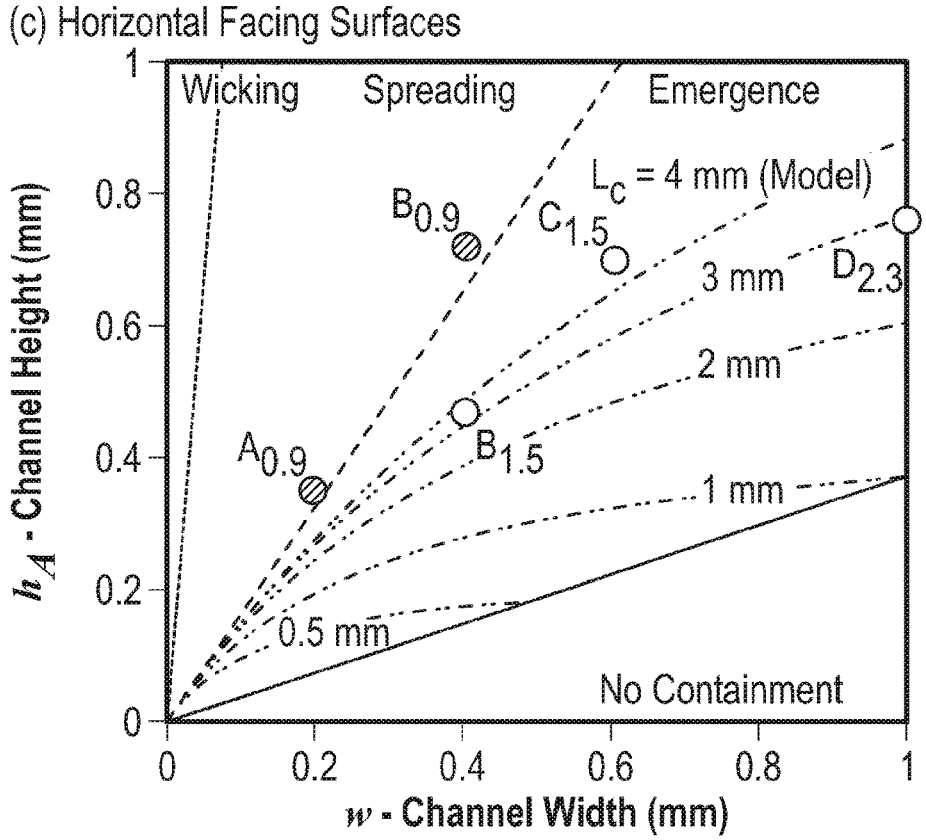
FIG. 7A is a graph showing predicted wetting states for a horizontally-oriented tube.
Figure 7B:
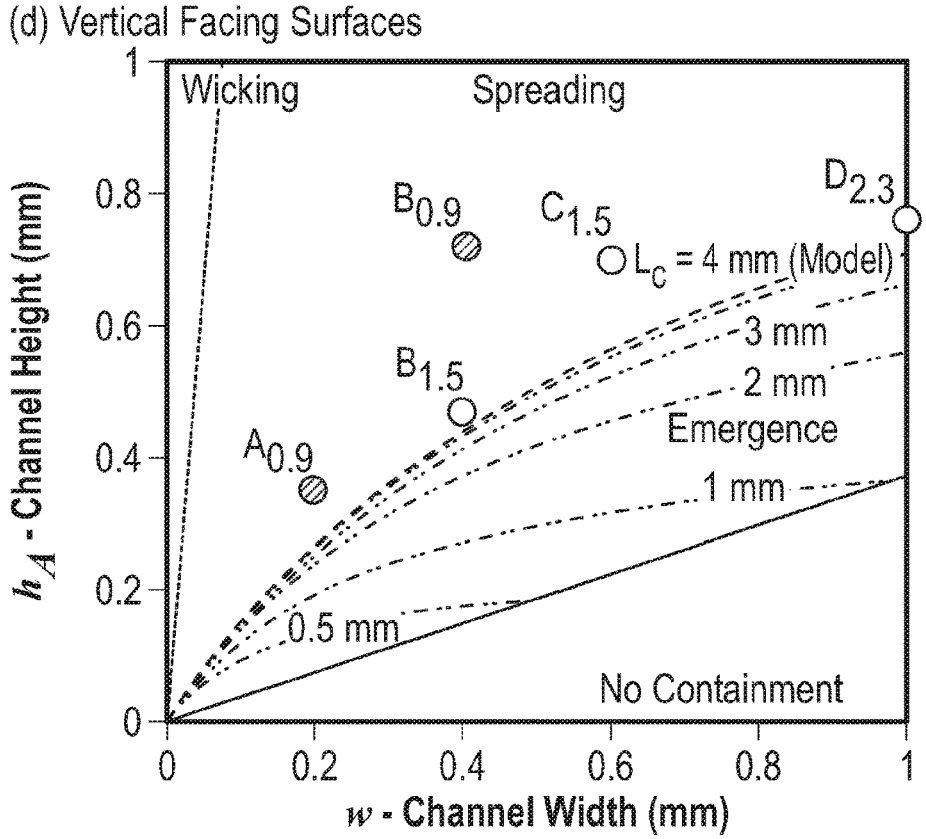
FIG. 7B is a graph showing predicted wetting states for a vertically-oriented tube.

FIG. 5A-D show several select images from high speed visualization during condensation experiments. The effect of adding the coating 120 on droplet formation can be seen in 5A and 5B, while FIGS. 5C and 5D compare the behavior of the 'smallest' and 'largest' AMCs tested here. Two uncoated designs (FIG. 4A) and five AMC designs (FIGS. 4B, 4C and FIG. 5B-5D) were tested, and the results of droplet tracking and HTC can be seen in FIGS. 6A and 6B for a six inch long tube 110. The bare grooved metal ($A_0$) behaved as expected with hydrophilic wetting throughout the entire grooved structure, large diameter droplets departed infrequently. However, two distinct (and robust) modes of condensation were observed for the AMC designs: (1) a stable wetted-film spreading mode and (2) a dynamic cyclical draining mode. The "spreading" $A_{0.9}$ and $B_{0.9}$ surfaces (FIGS. 5C and 5B, respectively) had a reduced departure diameter and increased frequency, while exhibiting a relatively ordered spacing between pendant droplets. The surfaces also demonstrated the highest HTC. The "emerging" $B_{1.5}$, $C_{1.5}$, and $D_{2.3}$ surfaces (FIGS. 4B, 4C, and 5D, respectively) displayed much more chaotic behavior of coalescence, draining, and emergence processes. FIGS. 7A and 7B show the predicted wetting behavior of flat horizontal and vertical AMCs, mimicking the top/bottom and sides of the tubes. The predictions show that the $A_{0.9}$ and $B_{0.9}$ surfaces can maintain a stable wetted state on all sides while feeding a stationary pendant droplet. The other three surfaces would preferentially emerge and create shorter slugs that cannot bridge the circumference of the tube. This leads to the dynamic instabilities seen for these examples.

The Ph.D. dissertation entitled "Condensation on Amphiphilic Surfaces" by co-inventor Rebecca L. Winter is attached as an Appendix hereto and is incorporated herein by reference in its entirety.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A structure for enhancing condensation and wetting dynamics comprising:

a tubular substrate;

a channel formed in the substrate, forming fins, having a hydrophilic surface, each of the fins having a portion furthest from the substrate; and a hydrophobic coating over only the portion furthest from the substrate on each of the fins.

2. The structure according to claim 1, wherein the substrate comprises aluminum.

3. The structure according to claim 1, wherein the channel has a helical shape.

4. The structure according to claim 1, wherein the coating comprises rubber.

5. The structure according to claim 1, wherein, when a ratio of the height of each fin below the coating versus the distance between adjacent fins is between about 0.1 and about 10.

6. The structure according to claim 1, wherein the thickness of the coating is between about 0.1 and about 200 microns.

7. The structure according to claim 1, wherein a ratio of the height of each of the fins versus a height of each of the portion furthest from the substrate hang a hydrophobic coating is between about 0.01 and about 0.99.

8. A structure for enhancing condensation and wetting dynamics comprising:

a substrate;

a plurality of grooves in the substrate, forming a plurality of fins, the plurality of fins extending away from the substrate, each of the plurality of fins having a hydrophilic surface, each of the fins having a coating formed only on a coated portion furthest from the substrate.

9. The structure according to claim 8, wherein the coating comprises silicone rubber.

10. The structure according to claim 8, wherein the coating has a lower thermal conductivity than the substrate.

11. The structure according to claim 8, wherein the coating has a thickness of between 0.1 microns and 200 microns.

12. A structure for enhancing condensation and wetting dynamics comprising:

a tubular substrate;

a plurality of grooves in the substrate, forming a plurality of fins, the plurality of fins extending outwardly from the tubular substrate, each of the plurality of fins having:

an attached portion; and a free portion, distal from the attached portion, wherein each of the plurality of fins has a hydrophilic surface; and a coating on only the free portion of each of the plurality of fins.

* * * * *